United States Patent [19]

Valks

[11] 4,296,614

[45] Oct. 27, 1981

[54] LEATHER PRESS

[75] Inventor: Robert K. Valks, Wetherby, England

[73] Assignee: USM Corporation, Farmington, Conn.

[21] Appl. No.: 934,602

[22] Filed: Aug. 17, 1978

Related U.S. Application Data

[63] Continuation-in-part of Ser. No. 895,740, Apr. 13, 1978.

[30] Foreign Application Priority Data

Aug. 27, 1977 [GB] United Kingdom ..... 36086/77

[51] Int. Cl.[3] ..... C14B 1/30

[52] U.S. Cl. ..... 69/48

[58] Field of Search ..... 69/48; 12/33.4, 36.5, 12/38, 53.5

[56] References Cited

U.S. PATENT DOCUMENTS 3,727,434 4/1973 Dokoupil ..... 69/48

3,872,695 3/1975 Busek ..... 69/48

*Primary Examiner*—Patrick D. Lawson

*Attorney, Agent, or Firm*—Donald N. Halgren

[57] ABSTRACT

A leather press in which two wedges are synchronously driven to raise a lower platen in the press from an open condition to a position adjacent an upper platen of the press. The lower platen is movably mounted on a support. The support and the wedges are in slidable engagement with one another to effect a preliminary closing of the press. A plurality of pressurizable members such as hydraulic pancake cylinders may be mounted between the movable platen and the support so that the platens are secondarily urged together by the application of hydraulic pressure, to apply the required working pressure, to a leather workpiece disposed between the platens. The hydraulic pancake cylinders are arranged to be disposed over a broad area of the lower platen to efficiently provide maximum pressure thereacross.

2 Claims, 9 Drawing Figures

LEATHER PRESS

CROSS REFERENCE TO RELATED APPLICATION

The present application in a continuation-in-part of U.S. patent application Ser. No. 895,740 filed Apr. 13, 1978.

BACKGROUND OF THE INVENTION

1. Field of the Invention

This invention is concerned with presses and more particularly to machines for pressing leather.

2. Prior Art

Hydraulic presses used for smoothing or embossing the surface of leather, comprise upper and lower platens between which the leather is pressed to a predetermined pressure. The upper platen is fixed and the lower platen is vertically movable between a position spaced apart from the upper platen (allowing an operator easy access to a workpiece between the platens), and a position separated from the upper platen only by the thickness of a workpiece between the two platens. Hydraulic cylinders are employed for moving the lower platen towards and away from the upper platen and for applying the required working pressure to the leather workpiece.

Two small diameter hydraulic cylinders and one large diameter hydraulic cylinder are mounted on a base of the aforementioned prior art press. The two small diameter cylinders raise the lower platen from an open condition of the press until a light clamping pressure is exerted on a workpiece between the platens. The large diameter cylinder is pressurized to exert a high load on the lower platen to press the workpiece to the required predetermined pressure. The large diameter cylinder is expensive however, and needs a very large quantity of hydraulic fluid under pressure very quickly to the large diameter cylinder to raise the lower platen at an acceptable speed, and hence, is a drawback associated with the prior art.

BRIEF SUMMARY OF THE INVENTION

The embodiments of the present invention comprise a fixed, heated, upper platen, a vertically movable lower platen mounted on a support (hereinafter referred to as a bolster) and press closing means operative to effect a predetermined pressure upon a leather workpiece positioned between opposed the horizontal surfaces of the platens.

The press closing means comprises two wedge members in sliding engagement with the bolster, and wedge driving means. The wedge driving means comprises a hydraulic cylinder secured to each wedge member and synchronizing means, so that the cylinders are operative to synchronously move the two wedge members towards one another to raise the bolster and the lower platen. The press closing means also comprises an arrangement of hydraulic pancake cylinders and rams disposed therein between the lower platen and the bolster wherein admission of a small amount of hydraulic fluid under pressure to the hydraulic pancake cylinders permits the lower platen to be urged towards the upper platen by the rams in the pancake cylinders.

The use of small stroke hydraulic pancake type rams require only a minute change in volume when applying pressure to a workpiece in the press. The pancake rams eliminate elaborate valve requirements of other presses, and promote more efficient use of the pressure applied, as well as the more efficient use of any hydraulic fluid required.

BRIEF DESCRIPTION OF THE DRAWINGS

The various objects and advantages of the present invention will become more apparent from the following detailed description, to be read with reference to the accompanying drawings, in which.

DESCRIPTION OF THE PREFERRED EMBODIMENTS

Figure 1:
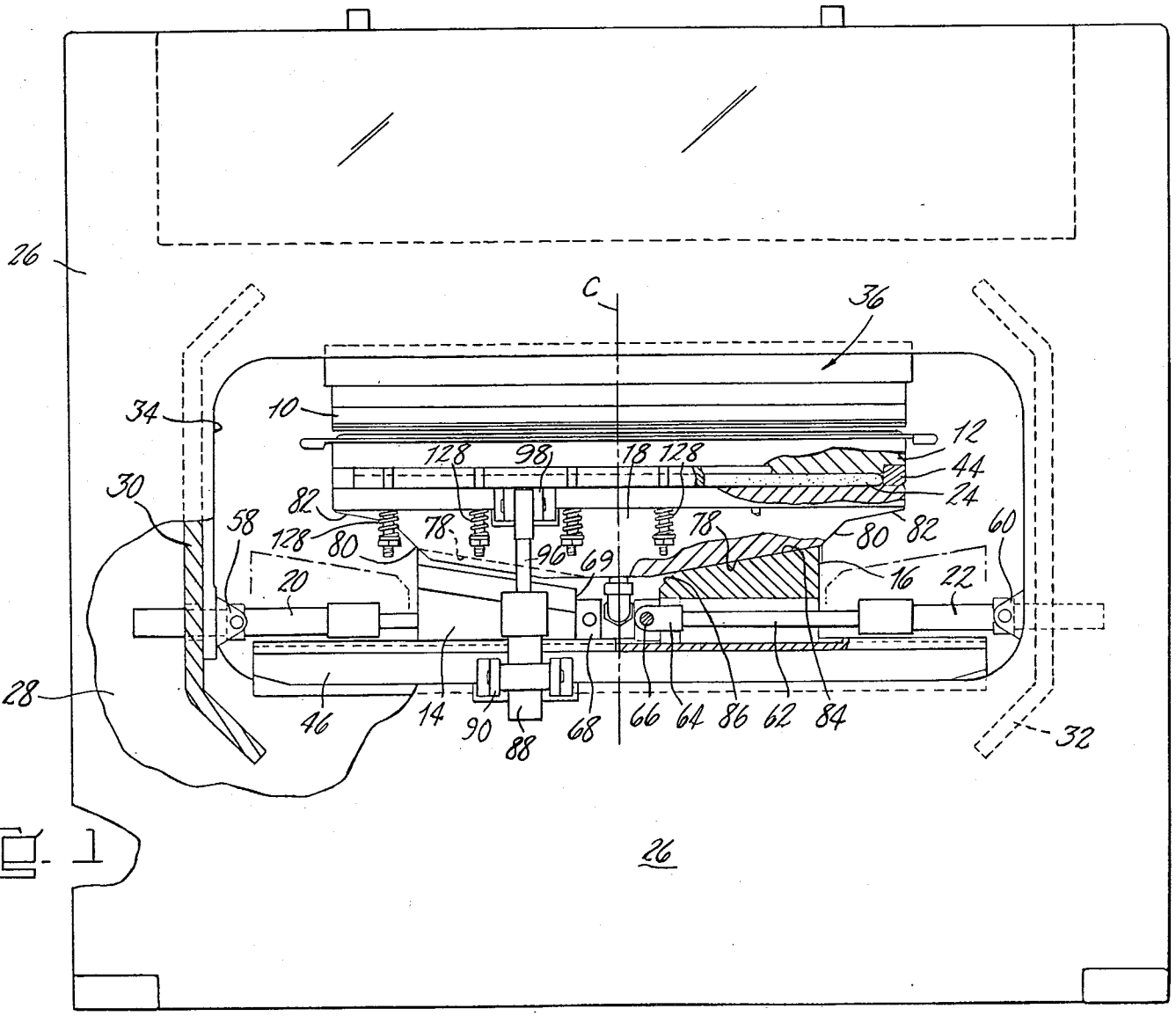
FIG. 1 is a front elevational view, partly in section, of the first embodiment of the press in a partially closed condition.

Referring to the drawings in detail, and particularly to FIG. 1, there is shown a leather press comprising an upper platen 10, a lower platen 12, and press closing means.

The press closing means comprises a pair of wedge members 14 and 16, in sliding engagement with a bolster 18. The bolster 18 provides a support on which the lower platen 12 is mounted. The press closing means includes a wedge driving arrangement wherein a pair of double-acting hydraulic cylinders, 20 and 22, supplied by a pressurized hydraulic system, synchronously move the two wedge members linearly towards one another and the centerline of the press, as indicated by C in FIG. 1, to raise the bolster 18 and the lower platen 12. The press closing means may also comprise in one embodiment, an inflatable sac 24, operable after movement of said wedge members, 14 and 16. The press closing means of the inflatable sac embodiment comprises an upper wall portion which provides a distensible diaphragm mounted between the bolster and the lower platen. Admission of fluid under pressure into the inflatable sac 24 permits the upper and lower platens to be urged together.

Figure 2:
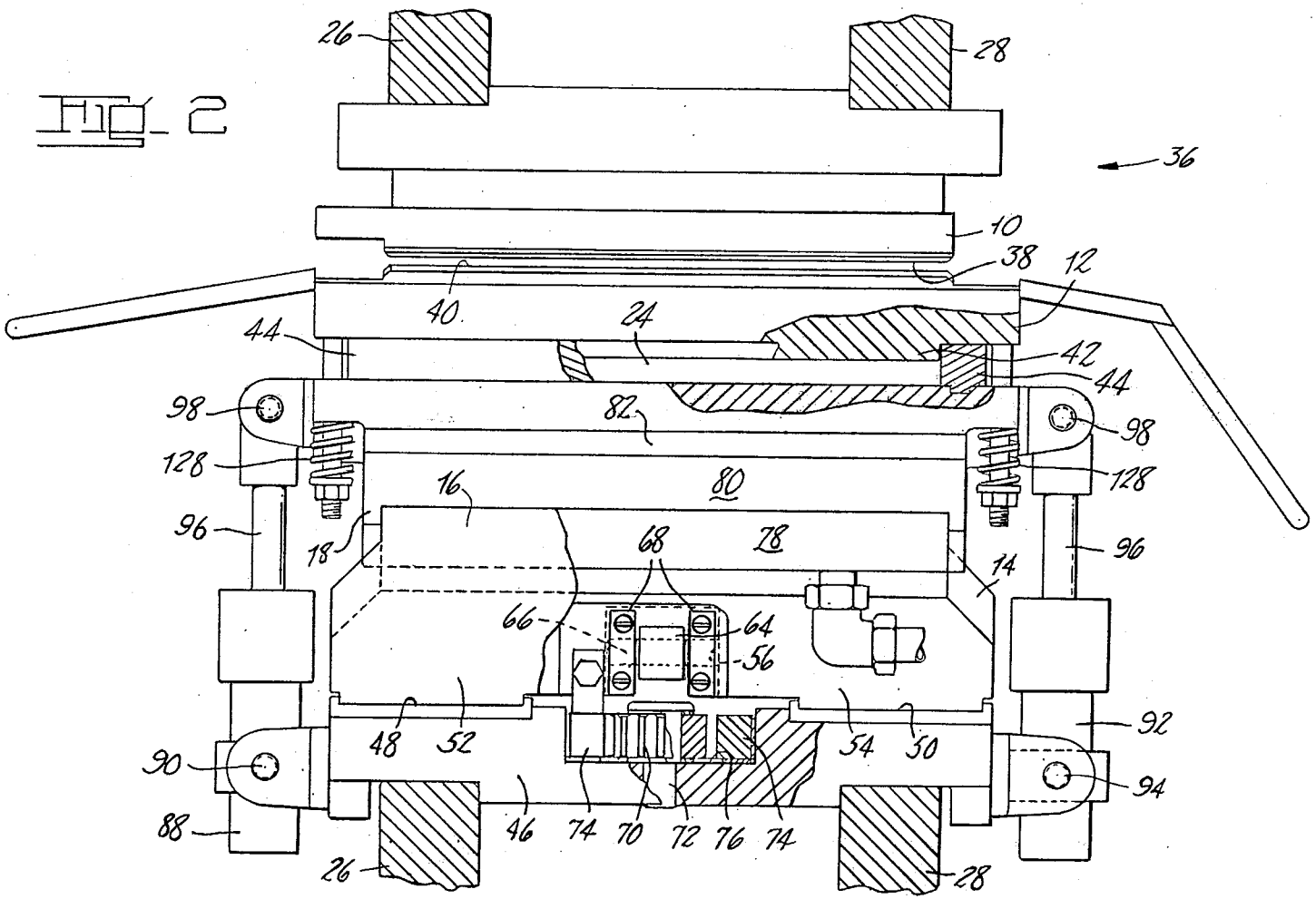
FIG. 2 is an elevational view, partly in section, from the right-hand side of the first embodiment of the press in the condition shown in FIG. 1.

As shown in FIGS. 1 and 2, the presses each comprise a rigid machine frame. The frame includes a vertical front wall 26 and a vertical rear wall 28 (parallel to the front wall). A pair of spacer plates 30 and 32, are generally vertically arranged between the front and rear walls. The front and rear walls, 26 and 28, each have a generally rectangular opening 34 disposed therein and aligned with one another. A fixed upper platen assembly 36, comprising the upper platen 10, is secured astride the front and rear walls, 26 and 28, along the top edges of the opening 34 so that the upper platen presents a horizontal downwardly facing work surface 38.

Figure 5:
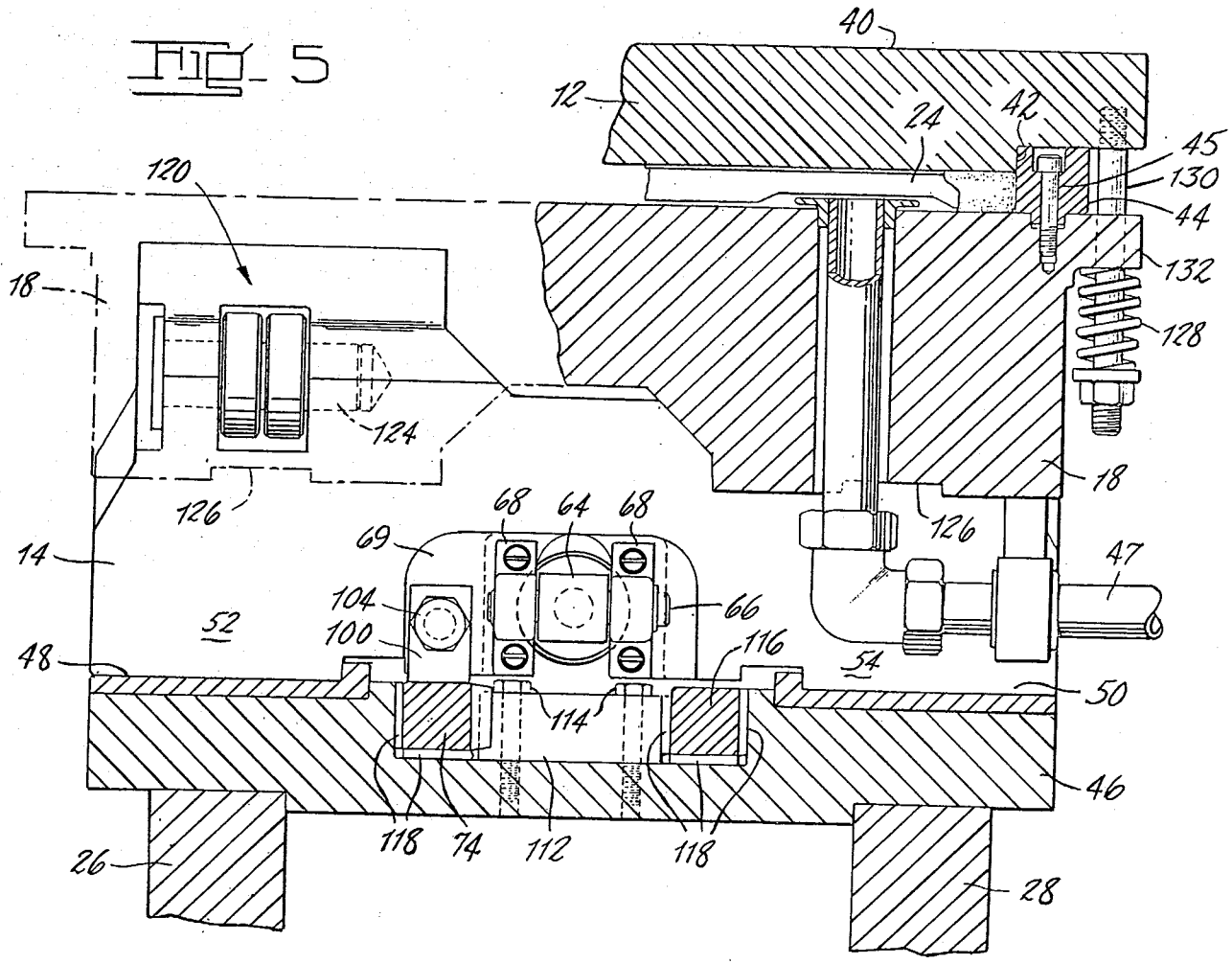
FIG. 5 is a view in elevation from the centerline of the second embodiment of the press looking in the direction of the arrow A in FIG. 4, the bolster and lower platen being partially cut away.

The lower platen 12 presents a horizontal upwardly facing work surface 40 in opposition to the downwardly facing surface 38 of the upper platen 10. The lower platen 12 comprises a rectangular boss 42 which is located in a shallow cavity on top of the bolster 18. The cavity is provided by an arrangement of four support strips 44, wherein the platen can rest on the support strips 44 and be guided thereby for small vertical movements. An array of six compression springs 128 are mounted along each side of the press, as shown in FIGS. 1, 2 and 5, and act to depress the lower platen 12 onto the support strips 44. The springs 128 are each mounted on a stud 130. Each stud 130 is secured in the lower platen and extends vertically downwards through a clearance hole in a ledge portion 132 of the bolster 18. The four support strips 44 are secured by an arrangement of bolts 45 to an upper surface of the bolster 18, as shown in FIG. 5. The preliminary embodiment of the press closing comprising the inflatable sac 24 is located in the cavity bounded by the strips 44, the upper surface of the bolster 18 and the boss 42 of the lower platen 12. As also shown in FIG. 5, a pipe 47 passes through the bolster 18 to the sac 24 to permit the feeding of hydraulic fluid under pressure to the sac 24. The sac 24 may be constructed of woven nylon and neoprene rubber materials and would have to withstand an internal pressure of 1500 p.s.i. when constrained between the bolster 18 and the lower platen 12.

A base member 46 is mounted astride the front and rear walls, 26 and 28, along bottom edges of the openings 34 as shown in FIGS. 2 and 5. The base member 46 provides two parallel, upwardly, facing, horizontal, slideways for the wedge members, 14 and 16. The base member 46 permits movement of the wedge members transversely of the press, there being a front slideway 48 and a rear slideway 50. Each of the wedge members 14 and 16, comprise a front foot portion 52 and a rear foot portion 54, as shown in FIGS. 2 and 5, which stand on the front and rear slideways, respectively, bridging a tunnel 56 therebetween, as shown in FIG. 4, which tunnel 56 extends for the whole length (transversely of the press) of the two wedge members, 14 and 16.

The two wedge members, 14 and 16, are mounted to slide towards and away from each other (and the centerline C of the press) transversely of the press on the base member 46. One of the two hydraulic cylinders 20 and 22, is secured to each of the wedge members to effect their respective sliding movement.

Figure 3:
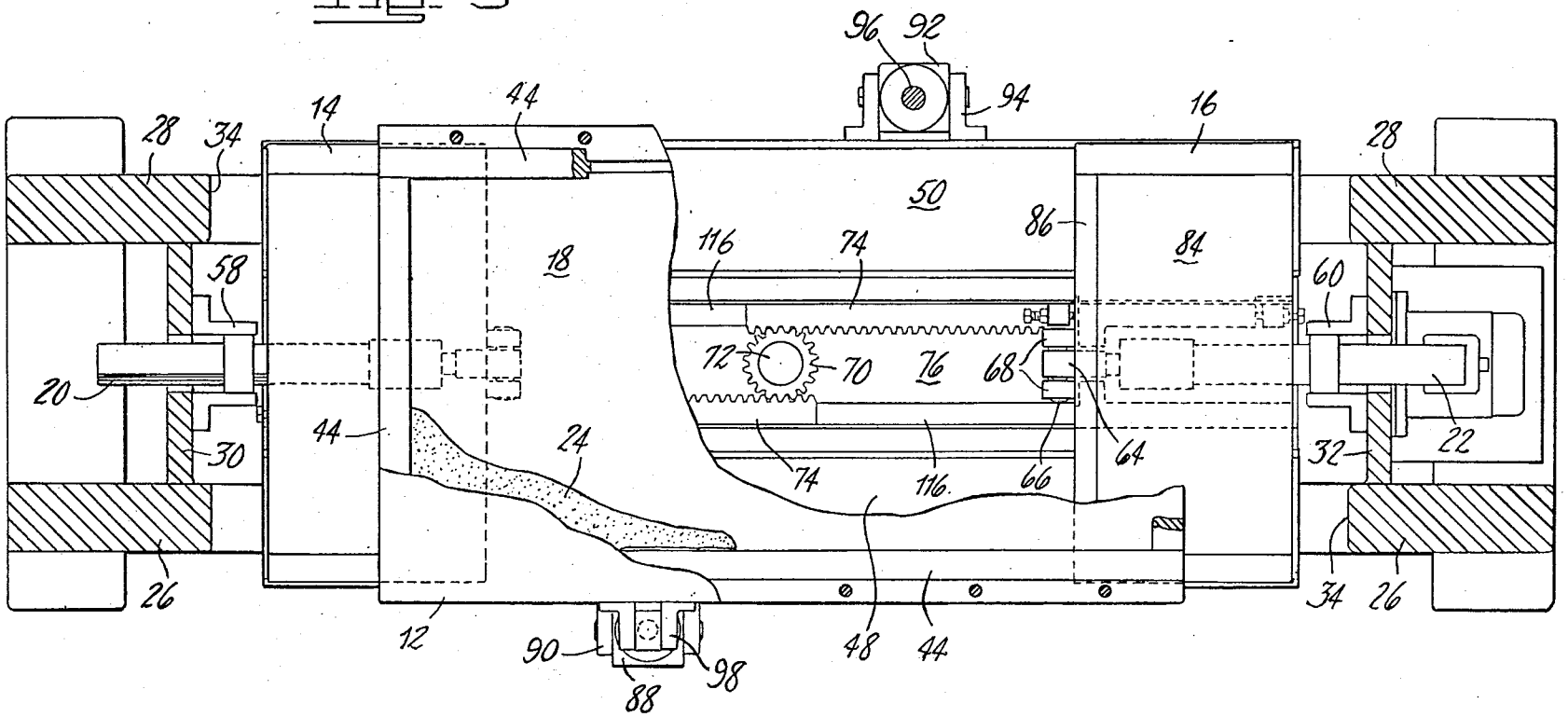
FIG. 3 is a plan view of the first embodiment of the press, in an open condition, most of a lower platen and bolster being cut away to reveal two synchronized wedge members mounted on a base member of the press.
Figure 4:
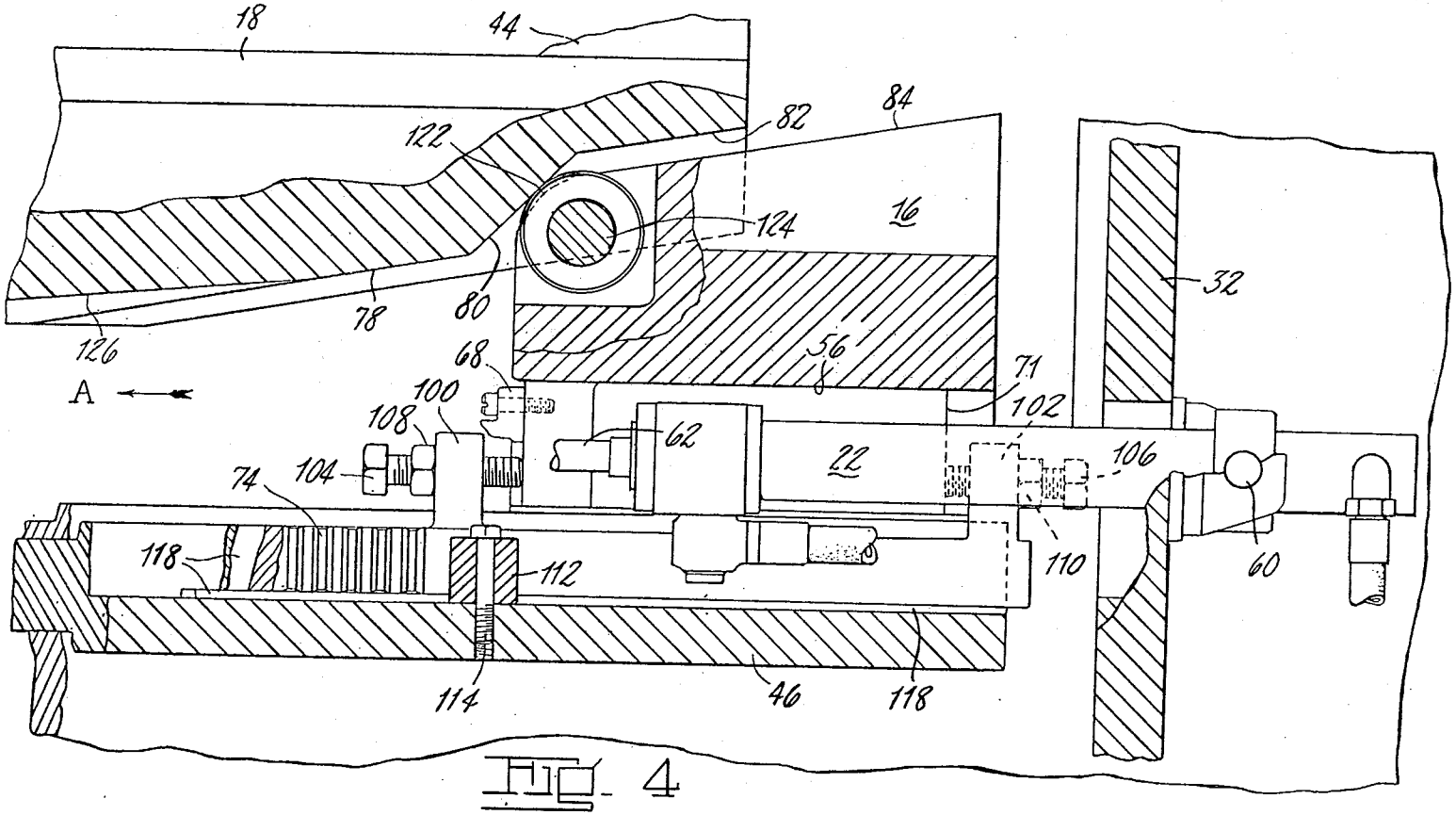
FIG. 4 is a sectional view in elevation from the front of a second embodiment of the press, showing engagement of a wedge member with a bolster of the press.

The two hydraulic cylinders, 20 and 22, are each mounted, as shown in FIGS. 1, 3 and 4, towards each side of the press outwardly of the wedge members. Both of the cylinders, 20 and 22, are aligned transversely of the press and are each mounted on a trunnion mounting, 58 and 60, which permit small pivotal movements of the cylinders about horizontal axes extending longitudinally of the press. A piston rod 62 extends from each of the cylinders, 20 and 22, towards the centerline of the press. Each piston rod 62 passes through the tunnel 56 between the front and rear foot portions of its associated wedge member, 14 or 16. A head block 64 is disposed at the distal end of each piston rod 62, and carries a pivot pin 66 which projects from each side of the block 64 longitudinally of the press. The projecting portions of each pin are pivotally received in two carrier blocks 68. The carrier blocks are secured to a machined surface 69 facing the centerline of the press. The hydraulic cylinders, 20 and 22, are thereby secured to the wedge members, 14 and 16, and are operable to drive them along the horizontal slideways of the base member 46.

One embodiment of the wedge synchronizing means comprises a toothed pinion wheel 70 which is mounted on the centerline of the press midway between the front and rear slideways, 48 and 50, of the base member, for rotation about a vertical axis. The wheel 70 is rotatably mounted on a headed axle pin 72 in a channel 76 of the base member 46 between the slideways, 48 and 50. A straight toothed rack member 74 is secured to each of the wedge members, 14 and 16. The two rack members 74 are arranged to slide along opposite side walls of the channel 76 on diametrically opposite sides of the pinion wheel 70. The racks 74 and the pinion wheel 70 are engaged to permit the two wedge members, 14 and 16, to move synchronously. A scotch bar 116 is secured to the end of each rack member 74.

Each rack member 74, as shown in FIGS. 4 and 5, has two upstanding lugs. An inner lug 100 is disposed adjacent the machined face 69 of its associated wedge member and an outer lug 102 is disposed adjacent an outer machined face 71 of its associated wedge member. A pair of bolts, 104 and 106, are screwed through the lugs 100 and 102, respectively, to engage the machined faces, 69 and 71. A pair of lock nuts, 108 and 110, secure the rack member 74 in adjusted position relative to the wedge member. A pair of spacing blocks 112 (one each shown in FIGS. 4 and 5) are each secured by an arrangement of bolts 114 to the base member 46 in the channel 76. The spacing blocks 112 maintain the separation of the rack members 74. The spacing blocks 112 each extend between one of the rack members 74 and the scotch bar 116 secured to the end of the other rack. A pair of brass bearing strips 118 are provided to permit the free running of the rack members 74 against the base member 46 and the spacing blocks 112. Both of the rack members 74 being in simultaneous engagement with a common pivot gear 72 effectuating the synchronous movement in the wedges, 14 and 16.

Another more preferred embodiment of the wedge synchronizing means comprises a hydraulic balancing arrangement without the need for a pinion wheel, axle pin, or racks. The hydraulic balancing arrangement may comprise a flow divider in the pressurized hydraulic supply system or may be included with one of the double-acting cylinders 20 or 22, to provide synchronous movement between the two wedges, 14 and 16.

The bolster 18, and the lower platen 12, are supported by the wedge members, 14 and 16, on the base member 46. A bottom surface of the bolster 18 is machined to provide slideways extending transversely of the press parallel to the slideways, 48 and 50, of the base member 46, as shown in FIG. 2. The slideways permit sliding engagement with the wedge members, 14 and 16. The bolster slideways on each side of the centerline C comprise, as shown in FIGS. 1 and 4, an inner portion 78 at about 10° to the horizontal, a middle portion 80 may be disposed in a range of about 20° to about 45°, preferably 30° to the horizontal, and an outer portion 82 at 10° to the horizontal. Each of the wedge members, 14 and 16, has a primary flat bearing surface 84, at 10° to the horizontal. The wedge members of the first embodiment of the press as shown in FIG. 1, also have a secondary flat bearing surface 86 correspondingly disposed in a range of about 20° to about 45°, preferably 30° to the horizontal.

The wedge members, 14 and 16, of the second embodiment of the press as shown in FIGS. 4 and 5, each comprise two pairs of rollers, a front pair 120 and a rear pair 122 mounted for rotation about horizontal shafts 124, which take the place of the 30° secondary bearing surface 86 of the wedge members of the first embodiment of the press. In the second embodiment of the press, the bottom surface of the bolster 18 is additionally machined to provide runways 126 to receive the rollers 120 and 122. The runways 126 are channels machined out of the 10° inner portions 78 of the bolster slideways at 5° to the horizontal.

The first embodiment of the press (but not the second embodiment of the press) also comprises a front and a rear single-acting hydraulic lifting cylinder, 88 and 92, as shown in FIGS. 1 and 2, which are arranged to lift the bolster 18 vertically in cooperation with the wedge members, 14 and 16. The front cylinder 88 is mounted by a trunnion mounting 90 to a front face of the base member 46, and the rear cylinder 92 is mounted by a trunnion mounting 94 to a rear face of the base member 46. The lifting cylinders, 88 and 92, are spaced equally from, but to opposite sides of, the press centerline C. A piston rod 96 extends vertically upwards from each of the lifting cylinders, 88 and 92, and is pivotally secured about an upper pivot pin 98, to the bolster 18. Actuation of the lifting cylinders, 88 and 92, causes a lifting force to be applied to the bolster 18.

With the first embodiment of the press in its open condition the wedge members, 14 and 16, are in the positions shown in chain-dot lines in FIG. 1. The bolster 18 is shown resting on the wedge members 14 and 16, with the outer portions 82 of the bolster slideways lying against the primary bearing surface 84 of the wedge members, and the middle portions 80 lying against the secondary bearing surfaces 86. The inflatable sac 24 embodiment, is, in this condition, of the press, deflated. The upper platen is heated to about 200° F.

A leather workpiece is placed on the upper work surface 40 of the lower platen 12 by an operator of the press. Hydraulic pressure is then admitted to the two lifting cylinders, 88 and 92, and to the wedge driving cylinders, 20 and 22. The bolster 18 is thereby lifted vertically and the wedge members, 14 and 16, are driven horizontally inwardly towards the centerline of the press. Lifting of the bolster 18 continues until the workpiece is clamped between the upper work surface 40 of the lower platen 12 and the work surface 38 of the upper platen 10. The wedge members, 14 and 16, are at this time in the positions shown by the solid lines in FIG. 1 and urged inwardly by the cylinders, 20 and 22, to exert a clamping pressure on the workpiece. After the workpiece has been clamped, pressure is caused to build up in the hydraulic system to operate a switch which causes hydraulic fluid to be admitted to the press closing means which in this embodiment is the inflatable sac 24. A pressure of about 1350 p.s.i. is admitted to the sac 24 to apply the required pressure to the leather workpiece between the platens 10 and 12. The lower platen 12 is thereby lifted a small distance guided by the support strips 44. The sac 24 is arranged to increase in depth from about 30 mm when uninflated, to about 36 mm when pressurized to about 1350 p.s.i..

After the workpiece has been held under pressure for a required time, the inflatable sac 24 of the present closing means embodiment, and the lifting cylinders 88 and 92, are depressurized and the cylinders 20 and 22, are actuated to withdraw the wedge members, 14 and 16, and lower the bolster 18. The springs 128 serve to deflate the sac 24 and ensure that the lower platen is returned to its seating of the support strips 44. The operator can remove the workpiece when the press has returned to its open condition.

Operation of the second embodiment of the press is very similar to that of the first embodiment of the press except that the bolster 18 is lifted from an open condition of the press solely by the action of the wedge driving cylinders 20 and 22. The two pairs of rollers 120 and 122, enable the bolster 18 to be lifted by the wedge members, 14 and 16, without the need for lifting cylinders as in the first embodiment of the press. When the rollers, 120 and 122, have ridden onto the inner portions 78 of the bolster slideways they then progress into the runways 126. The primary bearing surfaces 84 of the wedge members, 14 and 16, come into sliding contact with the inner portions 78 of the bolster slideways, enabling the load of the bolster 18 to be taken solely on the bearing surfaces 84 of the wedge members by the time clamping pressure is applied to a workpiece and the sac 24 is inflated.

In the two embodiments of the presses to raise the lower platen from an open position to a position adjacent the upper platen, the inclination of the inner and outer slideway portions, 78 and 82, of the bolster 18 (and correspondingly of the primary bearing surfaces 84 of the wedge members, 14 and 16) is such that the wedge members, 14 and 16, are self-locking against the bolster 18, and no supplementary locking mechanism is needed to prevent outwards movement when a full load is exerted on the wedge members, 14 and 16, by pressurization of the closing means which in this embodiment comprise the inflatable sac 24. The steeply inclined middle portion 80 of the bolster slideway is provided to shorten the distance that the wedge members have to be moved to provide for an adequate clearance between the platens 10 and 12, when the press is in its open condition.

Additional embodiments of the press are similar to the aforementioned except for the press closing means which comprise hydraulic cylinders in place of the inflatable sacs. The press closing or pressure applying means comprising hydraulic cylinders as described herein may be used to replace the sac in a press generally similar to the second of the presses (FIGS. 4 and 5) described in the aforementioned earlier embodiments of the parent application as recited above.

Figure 7:
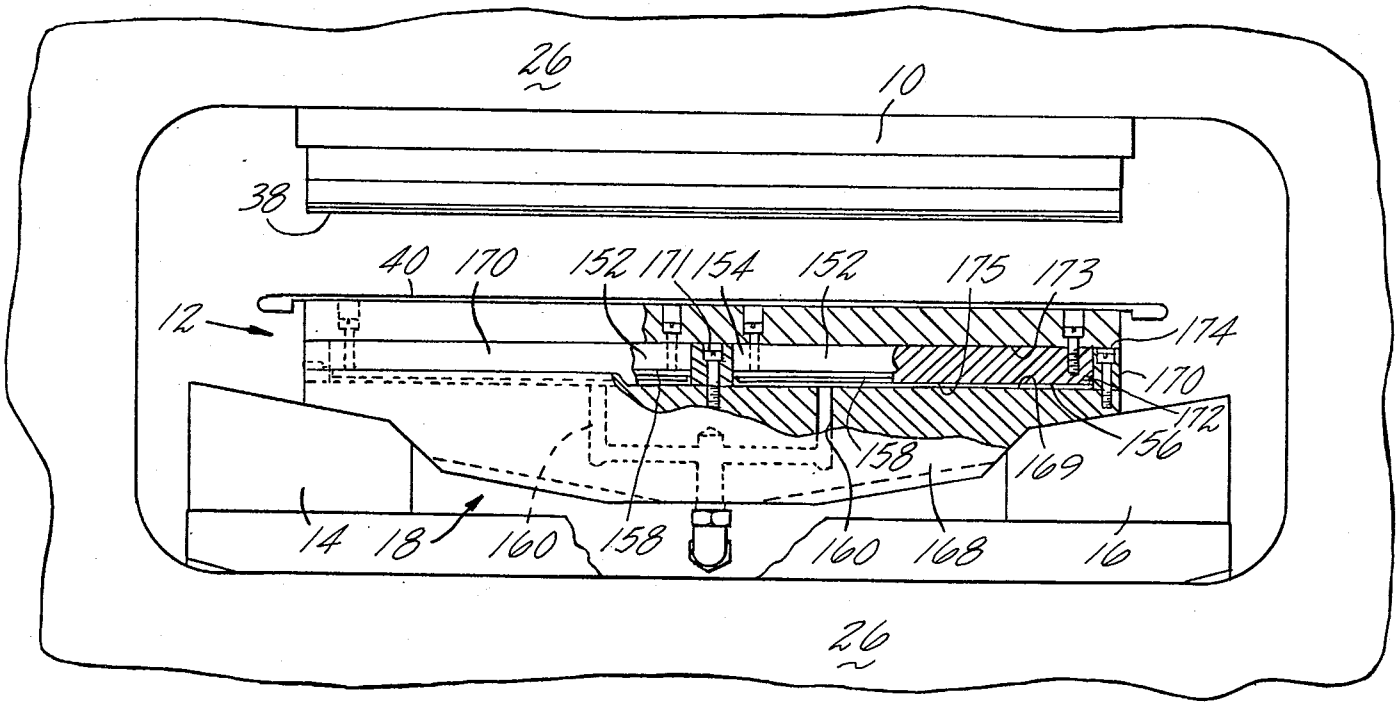
FIG. 7 is an elevational view, partly in section, from the front of the embodiment of the press in the condition shown in FIG. 6.

The further embodiments of the press also comprise the lower platen 12 and the upper platen 10, as shown in FIG. 7. The lower platen 12 is mounted on the bolster 18. From an open condition of the press the lower platen 12 may be raised towards the fixed upper platen 10, until a workpiece on the upper surface 40 of the lower platen 12 is positioned adjacent the upper platen, by aforementioned means comprising two wedge members, 14 and 16, in sliding engagement with the bolster 18. The wedge driving means comprising doubleacting hydraulic cylinders are shown in FIGS. 3, 4 and 5, and are operative to synchronously move the two wedge members linearly towards one another and towards the centerline of the press, to raise the bolster 18 and thereby raise the lower platen 12.

Figure 6:
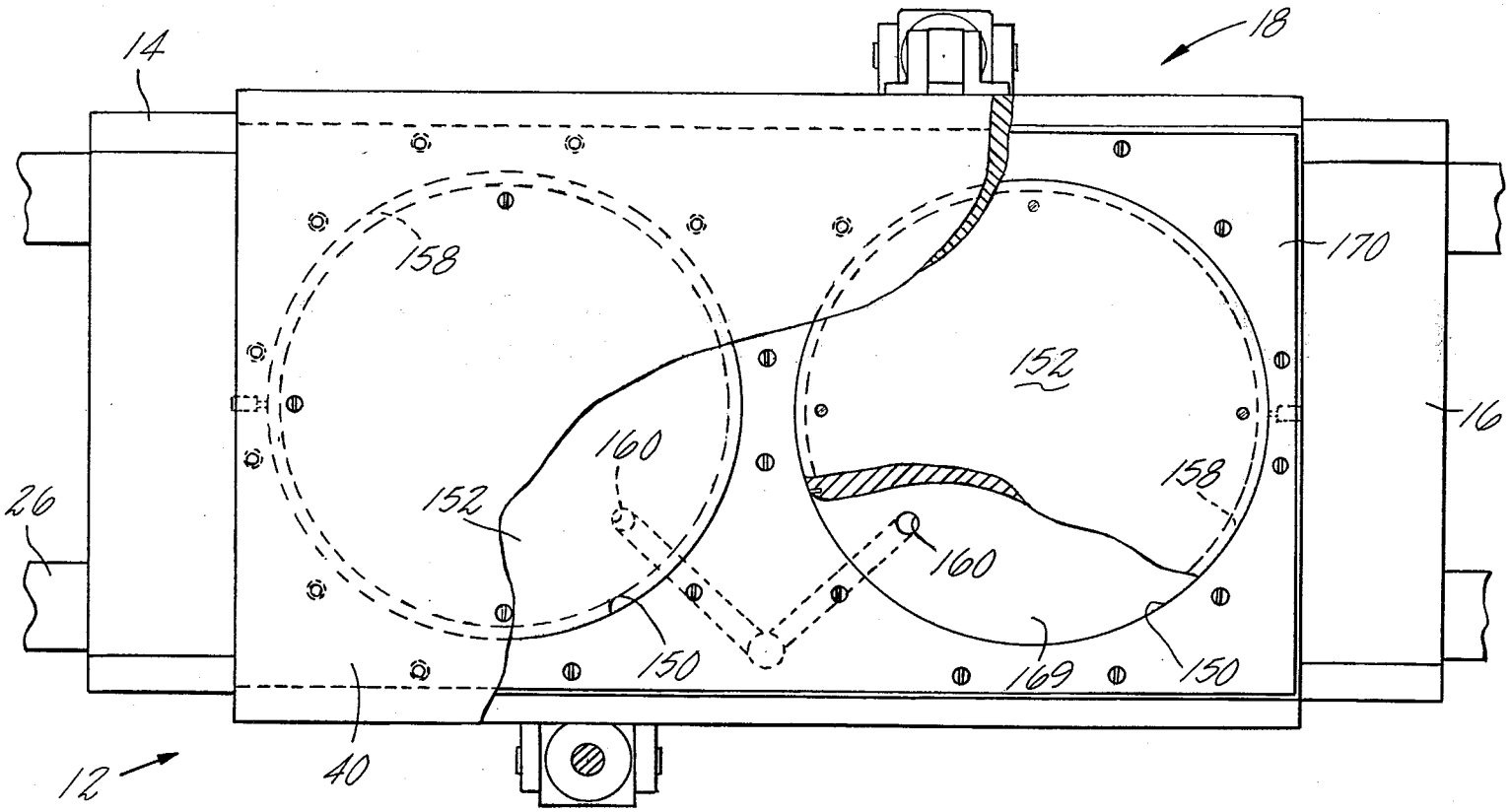
FIG. 6 is a plan view of a part of the press, showing a new embodiment of the lower platen thereof.

The bolster 18 of this embodiment, as shown in FIG. 7, comprises a body portion 168 having a flat upper surface 169. A cylinder plate 170 is secured by a plurality of screws 171 to the upper surface 169, as shown in FIGS. 6 and 7. A pair of cylinders 150 are formed by holes drilled through the cylinder plate 170. The bottoms of the cylinders 150 are provided by parts of the upper surface 169 of the body portion 168. A sealing member 172 surrounds each cylinder hole 150 in the cylinder plate 170 and forms a fluid-tight seal between the cylinder plate 170 and the body portion 168 thus ensuring that the cylinders 150 are fluid-tight. The cylinders 150 in the embodiment as shown in FIG. 6, are about 50 mm in depth and are of a maximum diameter slightly less than the width of the lower platen 12 from front to rear thereof. The two cylinders 150 are arranged side by side, as shown in FIG. 6, and are separated only by a narrow wall and extend almost to the left and right edges of the bolster 18 and platen 12. The cylinders 150 thus cover a substantial portion of the area of the lower platen 12.

The first embodiment of the pressure applying means as shown in FIGS. 6 and 7 of the present continuation-in-part application, comprises the cylinders 150 and also a movable piston or ram 152, slidingly arranged therein. The pancake rams 152 are so positioned on the lower platen 12 and are of such a diameter as to be slidingly received in the cylinders 150 of the bolster 18. Each pancake ram 152 comprises an upper portion 154, and a lower, step, portion 156 of slightly smaller diameter than the upper portion 154. Each upper portion 154 is in a sliding relationship with its cylinder 150. A hydraulic sealing member 158 is arranged around the step portion 156 and effects a fluid-tight seal between the rams 152 and the walls of the cylinder 150. The rams 152 are slightly shorter than the depth of the cylinders 150. The lower platen 12 has a lower surface 173, and the cylinder plate 170 has an upper surface 174. There is a small volume or clearance between a lower surface 175 of the lower step portion of the rams 156 and the upper surface 169 of the body portion 168 at the bottom of the cylinders 150. An arrangement of pipes 160 lead through the boister 18 and open into the bottom of the cylinders 150 through the surface 169 at the clearance or volume between the upper surface 169 of the body portion 168 and the bottom surface 175 of the rams 152.

The operation of the press is shown by the embodiments of FIGS. 6 and 7, with the press in the open condition, that is with a lower surface 38 of the upper platen 10 spaced apart from the upper surface 40, of the lower platen 12, and with the wedge members 14 and 16, in outer positions, as shown in FIG. 7. The bolster 18 is resting on the wedge members 14 and 16, and the cylindrical rams 152 are in a retracted position in the cylinders 150 so that the lower platen 12 rests on the bolster 18. A workpiece is laid on the upper surface 40 of the lower surface 12 and the wedge members 14 and 16, are moved towards each other, (as previously described) to raise the lower platen 12 towards the upper platen 10 until the workpiece on the lower platen 12 is positioned adjacent the upper platen 10. The workpiece is thereby clamped between the upper surface 40 of the lower platen 12 and the lower surface 38 of the upper platen 10. The wedge members 14 and 16, are then urged inwardly toward one another so that they exert a clamping pressure on the workpiece. The upper platen 10 is heated to a desired temperature, for example about 200° F.

After the workpiece has been clamped, pressure is built up in the hydraulic system of the press as embodied in FIGS. 6 and 7, to operate a switch which causes hydraulic fluid to be admitted to the cylinders 150 through the pipes 160 below the rams 152. A pressure of about 1800 p.s.i. is admitted to the cylinders 150 to apply the required pressure to the workpiece between the upper and lower platens 10 and 12, the upper platen 12 being lifted, as a result, by a small distance e.g. about 5 mm.

After the workpiece has been held under pressure for a required period of time, the hydraulic fluid is exhausted through the pipes 160, from the cylinders 150, to lower the rams 152. The wedges 14 and 16, are withdrawn to lower the bolster 18 and also the lower platen 12. Springs (not shown) assist in lowering the platen 12 onto the bolster 18 to ensure that the lower platen 12 is returned to its seating on the bolster 18. When the press has returned to its open condition the operator can remove the workpiece.

Figure 8:
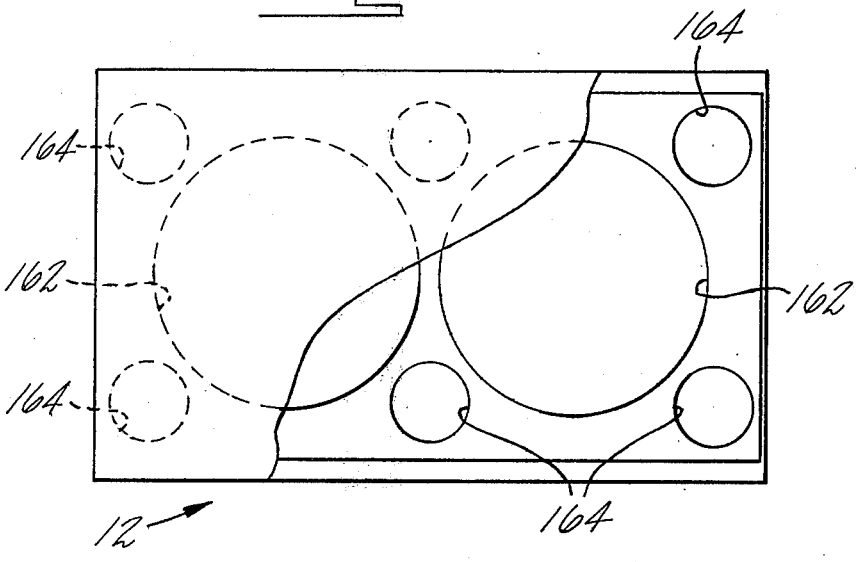
FIG. 8 is a plan view of another embodiment of the lower platen.

The next embodiment of the closing means of the press is shown in FIG. 8, wherein a pair of large diameter hydraulic cylinders 162 are machined through the cylinder plate 170 and are generally arranged similar to the two cylinders 150 of the previous embodiment of press but are somewhat smaller diameter, and embodiment also including a plurality (e.g. six) of smaller hydraulic cylinders 164 also machined into the cylinder plate 170. A ram generally similar in configuration to the rams 152 of the previous embodiment is slideably arranged within each of the cylinders 162 and 164 and are connected to the hydraulic system of the press so that they operate simultaneously to effect movement of the lower platen 12 on a bolster (not shown) in a manner similar to that hereinbefore described with reference to the earlier embodiment of the press. As can be seen from FIG. 8 of the drawings, the smaller diameter hydraulic cylinders 164 are positioned near the corners of the lower platen 12 and adjacent edge portions of the lower platen 12 between the large diameter cylinders 162. As the cylinders 164 are of smaller diameter than the cylinders 162 they can be positioned closer to the corners of the platen 12 to contribute to an improved overall support of the workpiece.

Figure 9:
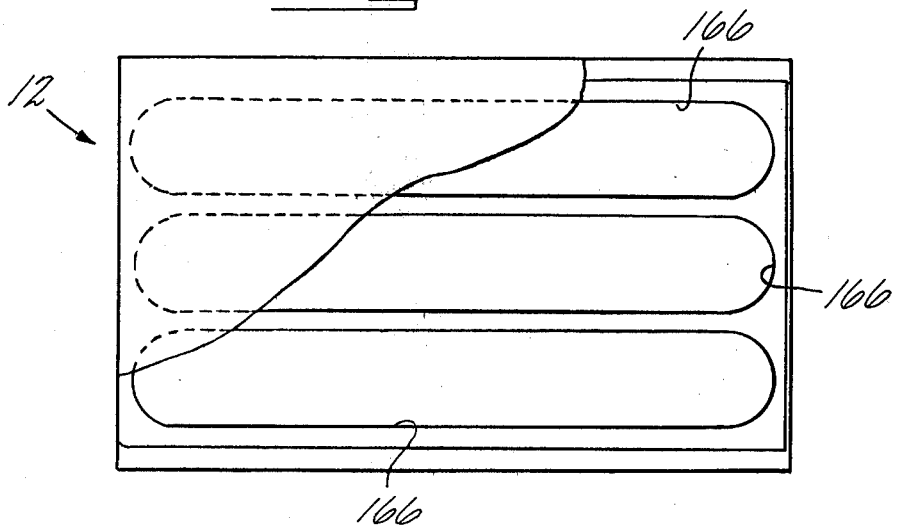
FIG. 9 is a plan view of a still further embodiment of the lower platen.

The third embodiment of the press closing means, as shown in FIG. 9, comprises a plurality (e.g. three) elongated cylinders 166 extending from left to right of the lower platen. The cylinders 166 are disposed parallel with the front edge of the lower platen 12 and are formed in an upper surface of a bolster. The pressure applying means of the third embodiment also comprises a number of rams (not shown) secured to the lower platen 12, each being slidingly received in the corresponding one of the cylinders 166. The rams have a similar stepped configuration to the rams 152 of the first illustrative press to accommodate a suitable sealing member and are of a similar depth.

The operation of the third embodiment of the press closing means is similar to that of the first embodiment of the press closing means wherein hydraulic fluid under pressure is admitted to the cylinders 166 simultaneously to apply a required pressure to a leather workpiece on the lower platen 12 thereof.

The rams in the cylinders 150, 162, 164 and 166 in the cylinder plate 170 comprising the press closing means all have a short stroke and thus change little in volume when applying pressure to the workpiece. The expensive pre-fill valve which has hitherto been employed in leather presses in which pressure is applied by operation of the hydraulic cylinders is eliminated. Cylinders of a larger diameter thus ensure that pressure is applied over a substantially greater area of the lower platen than occurs in the known hydraulically operated leather presses. In addition, because the stroke of the pistons or rams in the hydraulic cylinders of the known leather presses is much greater than that of the pistons or rams in the cylinders of the present invention, the machining of the cylinders in the cylinder plates of the present invention is simpler.

In presses constructed in accordance with the invention utilizing pressure applying means such as hydraulic cylinders and pistons or rams, any convenient number and shape of hydraulic cylinder may be selected, depending upon the shape (in plan) of the platens of the leather press and upon the amount of support which is necessary. It must be ensured that the hydraulic pressure is applied to a sufficient area of the platen of the press to give adequate support to the platen. In order to avoid the difficulties as associated with the prior art, it is important to keep the stroke of the pistons or rams in the hydraulic cylinders of presses in accordance with the present invention as short as practicable, preferably less then 7 mm and more preferably 5 mm or less.

I claim:

1. A machine for effecting a pressing operation on an article, said machine comprising;

a first platen and a second platen mounted in a frame of said machine;

a first closing means for urging movement of the first and second platens relative to one another, said article being disposed therebetween;

a second closing means for applying final predetermined pressure on said article disposed between said first and second platens;

said second closing means comprising at least two pressurizable members arranged with one of said platens, each of said pressurizable members includes a pancake ram slidingly disposed in a pancake cylinder in a cylinder plate disposed on a support plate, said pancake rams occupying a substantial surface portion of said platen, with a periphery having a step-like configuration thereon; and said pancake rams also have a sealing member arranged along its step-like periphery to ensure a sealing fit between said rams and said cylinders, said pancake rams being of elongated shape to permit said rams to extend generally into the corners of said platens.

2. A machine for effecting a pressing operation on an article, as recited in claim 1, wherein said cylinders extend through said cylinder plate, and said pancake rams being of smaller thickness than said cylinder plate to provide a volume between said support plate and said cylinder ram for pressurized expansion thereof.

* * * * *